US008840107B2

(12) United States Patent
Umi et al.

(10) Patent No.: US 8,840,107 B2
(45) Date of Patent: Sep. 23, 2014

(54) PAPER CONVEYANCE APPARATUS

(71) Applicant: PFU Limited, Kahoku (JP)

(72) Inventors: Takayuki Umi, Kahoku (JP); Masanobu Hongo, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/963,909

(22) Filed: Aug. 9, 2013

(65) Prior Publication Data

US 2014/0077440 A1 Mar. 20, 2014

(30) Foreign Application Priority Data

Sep. 14, 2012 (JP) ..... 2012-202627

(51) Int. Cl.

| | |
|---|---|
| ***B65H 7/02*** | (2006.01) |
| ***B65H 3/52*** | (2006.01) |
| ***B65H 7/06*** | (2006.01) |
| ***B65H 5/00*** | (2006.01) |
| ***B65H 3/06*** | (2006.01) |

(52) U.S. Cl.

CPC ..... *B65H 5/00* (2013.01); *B65H 3/5261* (2013.01); *B65H 7/06* (2013.01); *B65H 2511/528* (2013.01); *B65H 3/0661* (2013.01); *B65H 2553/30* (2013.01)

USPC ..... 271/258.01; 271/265.01

(58) Field of Classification Search

USPC ..... 271/256, 258.01, 258.04, 265.01; 399/21

See application file for complete search history.

(56) References Cited

U.S. PATENT DOCUMENTS

| | | | |
|---|---|---|---|
| 3,603,680 | A | 9/1971 | Barton |
| 7,502,570 | B2 | 3/2009 | Nishimura |
| 7,587,299 | B2 | 9/2009 | Miyasaka et al. |
| 8,567,777 | B2 | 10/2013 | Syracuse et al. |
| 8,585,050 | B2 | 11/2013 | Syracuse et al. |
| 2005/0189707 | A1 | 9/2005 | Sano et al. |
| 2007/0018376 | A1 | 1/2007 | Sano et al. |
| 2007/0177887 | A1 | 8/2007 | Haas et al. |
| 2009/0003857 | A1 | 1/2009 | Kuramochi et al. |
| 2009/0041485 | A1 | 2/2009 | Shoji et al. |
| 2012/0019841 | A1 | 1/2012 | Schaertel et al. |

(Continued)

FOREIGN PATENT DOCUMENTS

| | | |
|---|---|---|
| JP | 57-169767 | 10/1982 |
| JP | 03-175460 | 7/1991 |

(Continued)

OTHER PUBLICATIONS

Office action mailed Jul. 16, 2013 in JP 2012-185219, including English translation, 5pp.

(Continued)

*Primary Examiner* — David H Bollinger

(74) *Attorney, Agent, or Firm* — Christie, Parker & Hale, LLP

(57) ABSTRACT

A paper conveyance apparatus including a conveyance roller module including a pair of a sheet feeding roller and a separation roller opposite to each other across a paper conveyance path, a sound receiving aperture positioned on the same side as one side of the paper conveyance path, the one side including any one of the conveyance roller module, a sound shield positioned on a straight line between a nip portion of the conveyance roller module and the sound receiving aperture, a sound signal generator for generating a sound signal in response to a sound detected through the sound receiving aperture, and a sound jam detector for determining whether a jam has occurred based on the sound signal.

10 Claims, 12 Drawing Sheets

(56) References Cited

U.S. PATENT DOCUMENTS

| | | | |
|---|---|---|---|
| 2012/0235921 | A1 | 9/2012 | Laubach |
| 2012/0235929 | A1 | 9/2012 | Hongo et al. |
| 2013/0093136 | A1 | 4/2013 | Sakharshete et al. |
| 2013/0140757 | A1 | 6/2013 | Phinney et al. |
| 2013/0300056 | A1 | 11/2013 | Kai |
| 2014/0054252 | A1 | 2/2014 | Woodley et al. |
| 2014/0054840 | A1 | 2/2014 | Umi et al. |
| 2014/0054841 | A1 | 2/2014 | Morikawa et al. |
| 2014/0054849 | A1 | 2/2014 | Morikawa et al. |
| 2014/0054850 | A1 | 2/2014 | Umi et al. |
| 2014/0054851 | A1 | 2/2014 | Morikawa et al. |
| 2014/0054852 | A1 | 2/2014 | Hongo et al. |
| 2014/0062008 | A1 | 3/2014 | Hongo et al. |

FOREIGN PATENT DOCUMENTS

| | | |
|---|---|---|
| JP | 5-97283 | 4/1993 |
| JP | 5-97284 | 4/1993 |
| JP | 8-2746 | 1/1996 |
| JP | 11-116098 | 4/1999 |
| JP | 2001-302021 | 10/2001 |
| JP | 2005-082350 | 3/2005 |
| JP | 2005-249819 | 9/2005 |
| JP | 2006-201316 | 8/2006 |
| JP | 2006-290515 | 10/2006 |
| JP | 2006-322947 | 11/2006 |
| JP | 2007-86173 | 4/2007 |
| JP | 2008-207885 | 9/2008 |
| JP | 2009-249046 | 10/2009 |
| JP | 2010-030772 | 2/2010 |
| JP | 2010-54558 | 3/2010 |
| JP | 2011-180481 | 9/2011 |
| JP | 2011-254248 | 12/2011 |
| JP | 2012-6738 | 1/2012 |

OTHER PUBLICATIONS

Office action mailed Jul. 9, 2013 in JP 2012-202627, including English translation, 5pp.

Office action mailed Jul. 16, 2013 in JP 2012-195225, including English translation, 6pp.

Office action mailed Jul. 16, 2013 in JP 2012-195325, including English translation, 6pp.

Office action mailed Jul. 16, 2013 in JP 2012-195225, including English translation, 7pp.

Office action mailed Jul. 9, 2013 in JP 2012-203504, including English translation 5pp.

PAPER CONVEYANCE APPARATUS

CROSS-REFERENCE TO RELATED APPLICATIONS

This application is based upon and claims the benefit of priority of prior Japanese Patent Application No. 2012-202627, filed on Sep. 14, 2012, the entire contents of which are incorporated herein by reference.

TECHNICAL FIELD

Embodiments illustrated herein relate to a paper conveyance apparatus, and in particular to a paper conveyance apparatus that determines whether a jam has occurred during conveyance of a paper.

BACKGROUND

In a paper conveyance apparatus provided in an apparatus such as an image reading apparatus and an image copying apparatus, a jam may occur when a paper moves in a conveyance path. Some paper conveyance apparatuses include a function for determining whether a jam has occurred based on whether a paper has been conveyed to a predetermined position in a conveying path within a predetermined period of time after initiation of conveyance of the paper, and then terminating an operation of the apparatus when a jam has occurred.

Conventionally, there is known a sheet multiple feed detection apparatus that compares ultrasound attenuation information when a paper sheet has passed between a transmitter and a receiver with a threshold value for multiple feed detection to detect sheet multiple feed. A periphery of an ultrasound reception region of the sheet multiple feed detection apparatus is covered with a cylindrical noise shield wall.

There is known an abnormality determination apparatus including a microphone for detecting a sound generated from a subject to be detected and a determination unit for determining the presence or absence of abnormality of a subject to be detected based on a detection result by the microphone.

Further, there is known a multiple feed detection apparatus that transmits ultrasound from a transmitter to a receiver of an ultrasound sensor facing each other across a transfer sheet conveyance path, and compares an output signal by attenuation when a transfer sheet has passed between the transmitter and the receiver with a threshold value for multiple feed detection to detect multiple feed. To prevent disturbance, a cover is disposed on a receiver side of the multiple feed detection apparatus.

In addition, there is known a sheet stacking unit capable of stacking sheets, an optical sensor that detects the presence or absence of sheets stacked in the sheet stacking unit, and a sheet feeding apparatus that separates and feeds sheets one by one by a feeding unit based on a detection result of the optical sensor. A light shield for shielding outside light that enters the optical sensor is provided so as to be withdrawable from a sheet insertion opening of the sheet stacking unit.

Related art is disclosed in Japanese Laid-open Patent Publications No. 2008-207885, No. 2006-201316, No. 2005-82350 and No. 2010-30772.

SUMMARY

A jam generates a large sound in a conveyance path. Therefore, if a sound generated in the conveyance path is detected by a microphone (MIC), the jam may be detected. However, when a sound other than a sound generated by a jam overlaps with a sound detected up with the microphone, a detection accuracy of a jam may decrease.

Accordingly, the apparatus disclosed in the present specification is intended to reduce a decrease in a detection accuracy of a jam based on a sound generated in a conveyance path, the increase resulting from a sound other than a sound generated by jam occurrence.

In accordance with an aspect of the embodiment, there is provided a paper conveyance apparatus including a conveyance roller module including a pair of a sheet feeding roller and a separation roller opposite to each other across a paper conveyance path, a sound receiving aperture positioned on the same side as one side of the paper conveyance path, the one side including any one of the conveyance roller module, a sound shield positioned on a straight line between a nip portion of the conveyance roller module and the sound receiving aperture, a sound signal generator for generating a sound signal in response to a sound detected through the sound receiving aperture, and a sound jam detector for determining whether a jam has occurred based on the sound signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

The paper conveyance apparatus according to one aspect of this application will now be described with reference to the drawings. However, note that the technical scope of this application is not limited to these embodiments and extends to the inventions described in appended claims and their equivalents.

Figure 1:
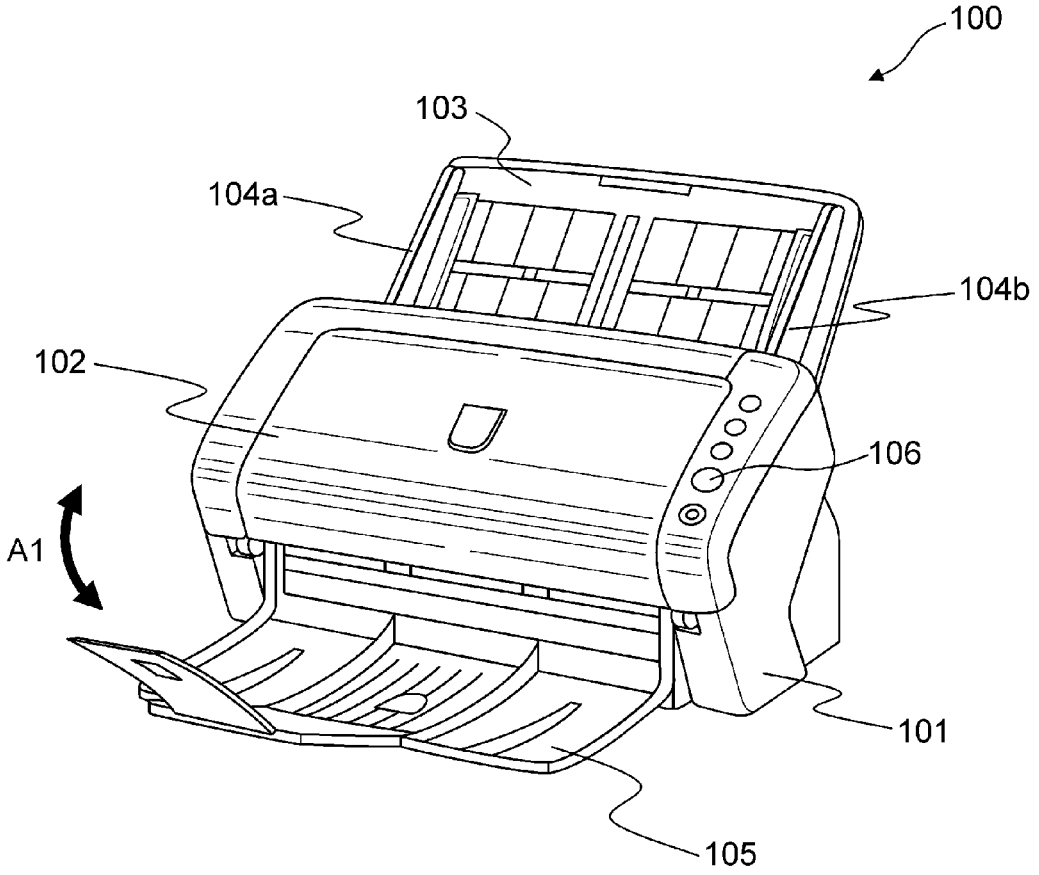
FIG. 1 is a perspective view illustrating a paper conveyance apparatus 100.

FIG. 1 is a perspective view illustrating a paper conveyance apparatus 100 configured as an image scanner. The paper conveyance apparatus 100 includes a lower housing 101, an upper housing 102, a paper table 103, a discharging table 105, and an operation button 106.

The lower housing 101 and the upper housing 102 are formed with a resin material. The upper housing 102 is disposed in a position covering an upper face of the paper conveyance apparatus 100, and engaged with the lower housing 101 using a hinge so as to be openable and closable at the time of jam occurrence of a paper and of cleaning inside the paper conveyance apparatus 100.

The paper table 103 is engaged with the lower housing 101 so as to place a paper thereon. The paper table 103 includes side guides 104*a* and 104*b* movable in a direction at right angles to a conveyance direction of a paper, i.e., in horizontal direction with respect to the conveyance direction of a paper. The side guides 104*a* and 104*b* are positioned to fit a width of a paper so that a width direction of the paper can be regulated.

The discharging table 105 is engaged rotatably with the lower housing 101 using a hinge in a direction as illustrated by an arrow A1 and can hold discharged papers while being opened as illustrated in FIG. 1. The operation button 106 is disposed on a surface of the upper housing 102 to produce and output an operation detection signal when pressed down.

Figure 2:
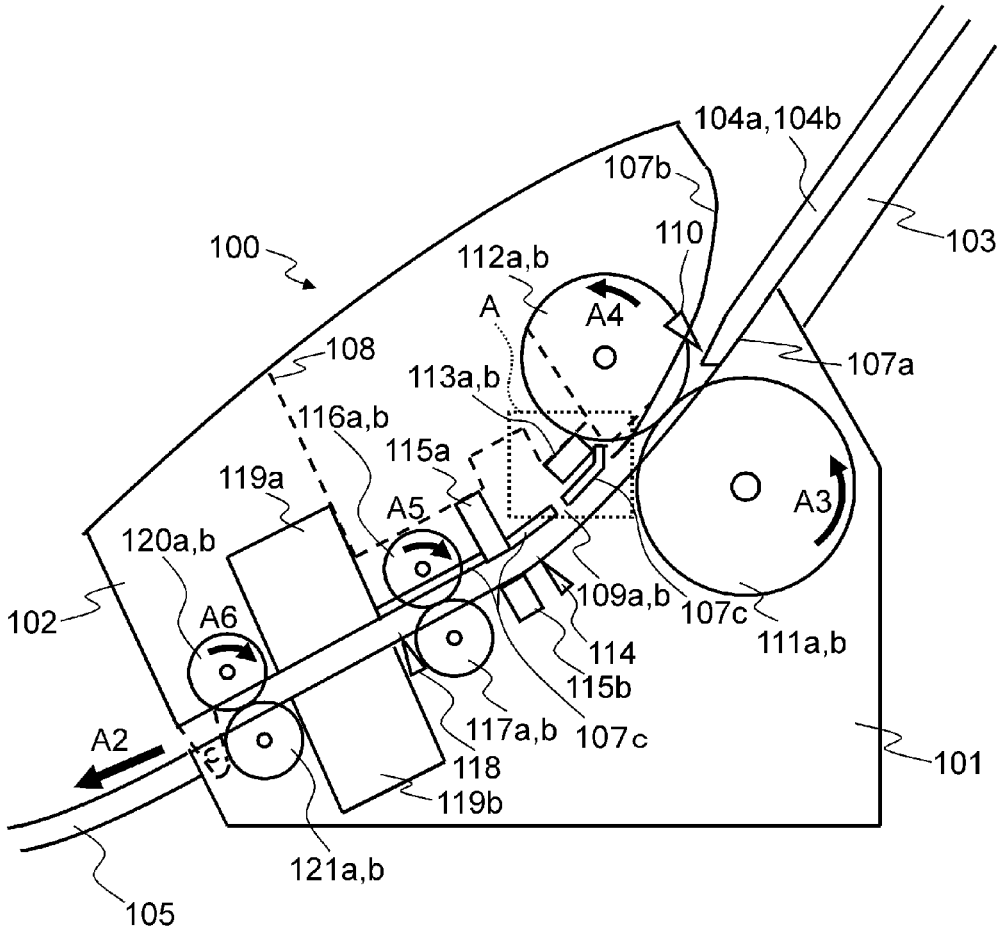
FIG. 2 is a view illustrating a conveyance path inside the paper conveyance apparatus 100.

FIG. 2 is a view illustrating a conveyance path inside the paper conveyance apparatus 100. In the conveyance path inside the paper conveyance apparatus 100, a first paper detector 110, sheet feeding rollers 111*a* and 111*b*, retard rollers 112*a* and 112*b*, a first microphone 113*a*, a second microphone 113*b*, and a second paper detector 114 are disposed. Further, in the conveyance path inside the paper conveyance apparatus 100, an ultrasound transmitter 115*a*, an ultrasound receiver 115*b*, first conveyance rollers 116*a* and 116*b*, first driven rollers 117*a* and 117*b*, a third paper detector 118, a first imaging unit 119*a*, and a second imaging unit 119*b* are disposed. In the conveyance path inside the paper conveyance apparatus 100, second conveyance rollers 120*a* and 120*b* and second driven rollers 121*a* and 121*b* and the like are disposed. Note that retard rollers 112*a* and 112*b* are one example of a separation roller.

Hereinafter, there are some cases where the sheet feeding rollers 111*a* and 111*b* are collectively referred to as a sheet feeding roller 111, the retard rollers 112*a* and 112*b* are collectively referred to as a retard roller 112, and the first conveyance rollers 116*a* and 116*b* are collectively referred to as a first conveyance roller 116. Also, in some cases, the first driven rollers 117*a* and 117*b* are collectively referred to as a first driven roller 117, the second conveyance rollers 120*a* and 120*b* are collectively referred to as a second conveyance roller 120, and the second driven rollers 121*a* and 121*b* are collectively referred to as a second driven roller 121.

An upper face of the lower housing 101 forms a lower guide 107*a* of the conveyance path of a paper, and a lower face of the upper housing 102 forms an upper guide 107*b* of the conveyance path of a paper. An arrow A2 in FIG. 2 indicates the conveyance direction of a paper. Hereinafter, an upstream refers to an upstream of the conveyance direction A2 of a paper, and a downstream refers to a downstream of the conveyance direction A2 of a paper.

The first paper detector 110 includes a contact detection sensor disposed on an upstream side of the sheet feeding roller 111 and the retard roller 112 to detect whether a paper is placed on the paper table 103. The first paper detector 110 produces and outputs a first paper detection signal having a signal value that changes depending on whether a paper is placed on the paper table 103.

The first microphone 113*a* and the second microphone 113*b* each detect a sound generated during conveyance of a paper to output an analog signal produced from a detected sound. The first microphone 113*a* and the second microphone 113*b* are fixed to a frame 108 inside the upper housing 102 formed by shaping the upper housing 102. An arrangement position of the first microphone 113*a* and the second microphone 113*b* may be, for example, a downstream side of the sheet feeding roller 111 and the retard roller 112.

Between the first microphone 113*a* and the conveyance path and between the second microphone 113*b* and the conveyance path, a guide member 107*c* functioning as an upper guide of the conveyance path is disposed. As illustrated in FIG. 2, the guide member 107*c* has a face facing the first microphone 113*a* and the second microphone 113*b*. To more easily carry out sound detection by the first microphone 113*a* and the second microphone 113*b*, the guide member 107*c* has apertures 109*a* and 109*b*.

The second paper detector 114 has a contact detection sensor disposed on a downstream side of the sheet feeding roller 111 and the retard roller 112 and also on an upstream side of the first conveyance roller 116 and the first driven roller 117 to detect whether a paper is present at a position of the sensor. The second paper detector 114 produces and outputs a second paper detection signal having a signal value that changes depending on whether a paper is present at a position of the detector.

The ultrasound transmitter 115*a* and the ultrasound receiver 115*b* are an example of an ultrasound signal output unit, which are disposed in the vicinity of the conveyance path of a paper so as to face each other across the conveyance path. The ultrasound transmitter 115*a* transmits ultrasound. On the other hand, the ultrasound receiver 115*b* detects ultrasound transmitted by the ultrasound transmitter 115*a* and passed through a paper to produce and output an ultrasound signal which is an electric signal in response to the detected ultrasound. Hereinafter, the ultrasound transmitter 115*a* and the ultrasound receiver 115*b* may also be referred to as an ultrasound sensor 115.

The third paper detector 118 has a contact detection sensor disposed on a downstream side of the first conveyance roller 116 and the first driven roller 117 and also on an upstream side of the first imaging unit 119*a* and the second imaging unit 119*b* to detect whether a paper is present at a position of the sensor. The third paper detector 118 produces and outputs a third paper detection signal having a signal value that changes depending on whether a paper is present at a position of the detector.

The first imaging unit 119*a* has a CIS (Contact Image Sensor) of a same magnification optical type with an imaging device using a CMOS (Complementary Metal Oxide Semiconductor) linearly arrayed in a main scanning direction. This CIS produces and outputs an analog image signal by reading a back side of a paper. In the same manner, the second imaging unit 119*b* has a CIS of a same magnification optical type with an imaging device using a CMOS linearly arrayed in the main scanning direction.

This CIS produces and outputs an analog image signal by reading a front side of the paper. Note that, either the first imaging unit 119*a* or the second imaging unit 119*b* may be disposed to read only one side of the paper. Further, instead of the CIS, an image sensor of a reduction optical type with an imaging device using a CCD (Charged Coupled Device) may be used. Hereinafter, the first imaging unit 119*a* and the second imaging unit 119*b* may also be referred to as an imaging unit 119.

A paper placed on the paper table 103 is conveyed toward the paper conveyance direction A2 between the lower guide 107*a* and the upper guide 107*b* by the rotation of the sheet feeding roller 111 in a direction of an arrow A3 of FIG. 2. In the same manner, the paper is conveyed toward the paper conveyance direction A2 between the lower guide 107*a* and the guide member 107*c*.

The retard roller 112 rotates in a direction of arrow A4 in FIG. 2 during conveyance of a paper. When a plurality of papers are placed on the paper table 103, only a paper in contact with the sheet feeding roller 111 among these papers placed on the paper table 103, is separated by an operation of the sheet feeding roller 111 and the retard roller 112. Further, the conveyance of papers other than a separated paper is restricted (prevention of multiple feed). The sheet feeding roller 111 and the retard roller 112 function as a separation unit of a paper.

While being guided by the lower guide 107*a*, the upper guide 107*b*, and the guide member 107*c*, the paper is sent in between the first conveyance roller 116 and the first driven roller 117. Then, the paper is sent in between the first imaging unit 119*a* and the second imaging unit 119*b* by the rotation of the first conveyance roller 116 in a direction of an arrow A5 of FIG. 2. Further, the paper read by the imaging unit 119 is discharged onto the discharging table 105 by the rotation of the second conveyance roller 120 in a direction of an arrow A6 of FIG. 2.

Figure 3:
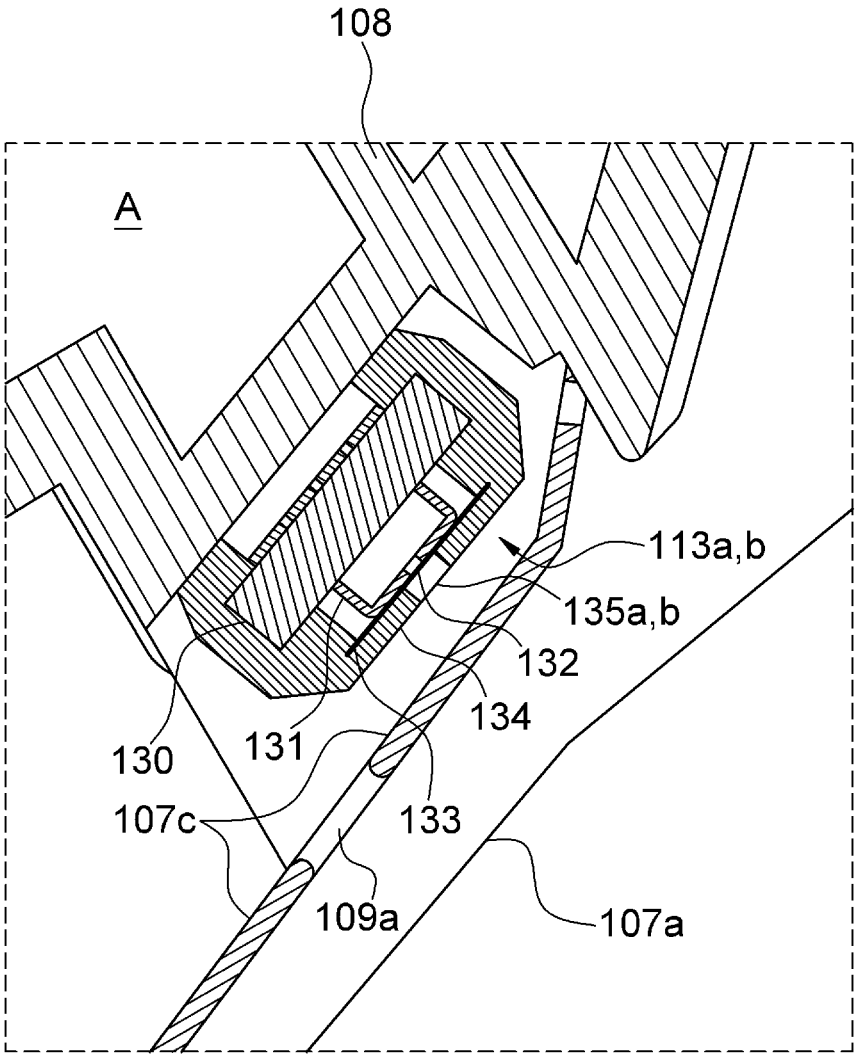
FIG. 3 is an enlarged view of the A portion of FIG. 2.

FIG. 3 is an enlarged view of the A portion of FIG. 2 where the first microphone 113*a* and the second microphone 113*b* are disposed. Hereinafter, the first microphone 113*a* will be described in more detail. Below is a description of the first microphone 113*a*, but the second microphone 113*b* is configured in the same manner.

The first microphone 113*a* includes a substrate 130 and a microphone device 131 electrically connected to this substrate 130. The microphone device 131 may be, for example, a MEMS (Micro Electro Mechanical Systems) microphone device or an electret condenser microphone (ECM) device. The microphone device 131 converts a sound received at a position of a sound aperture 132 disposed on a face opposite to a connection face with the substrate to an electric signal. The sound aperture 132 corresponds to a sound receiving aperture.

The first microphone 113*a* fixed to the frame 108 formed by shaping the upper housing 102, and a normal line of a face provided with the sound aperture 132 faces obliquely downward. Therefore, this reduces deposition of foreign matters in the sound aperture 132 and its periphery.

The face provided with the sound aperture 132 in the microphone device 131 has a woven cloth 133 so as to cover the sound aperture 132. The woven cloth 133 may be, for example, a cloth mesh having excellent air permeability. The woven cloth 133 has a role as a dust preventive member to reduce the intrusion of foreign matters into the microphone device 131. In another example, instead of the woven cloth 133, non-woven cloth may be used. However, the use of the woven cloth 133 makes an acoustic performance of the microphone device 131 more uniform than the use of the non-woven cloth.

The first microphone 113*a* includes a cap member 134 for pressing the woven cloth 133 to the microphone device 131. A material of the cap member 134 may be, for example, silicone rubber. Upon assembling the first microphone 113*a*, the cap member 134 can be attached to the substrate 130 in two different directions. The cap member 134 has two through-apertures 135*a* and 135*b*. Even when the cap member 134 is attached to the substrate 130 in any one of the two different directions, any one of the through-apertures 135*a* and 135*b* is aligned with the sound aperture 132. In the present example, the through-aperture 135*a* and the sound aperture 132 are aligned with each other.

The aperture 109*a* provided for the guide member 107*c* is disposed in a position separate from a position of the first microphone 113*a*. For example, the aperture 109*a* is disposed in a position separate from a position of the sound aperture 132 of the first microphone 113*a*. In the example of FIG. 3, the aperture 109*a* is disposed in a downstream of the conveyance direction from the position of the sound aperture 132.

When the positions of the aperture 109*a* and the first microphone 113*a* are displaced, it is difficult for foreign matters that have entered from the aperture 109*a* to reach the first microphone 113*a*. Further, at the time of cleaning by air ejection, breakage of the first microphone 113*a* due to direct application thereto with high-pressure air ejected to the aperture 109*a* can be prevented.

In addition, while the upper housing 102 is closed, the guide member 107*c* is inclined to a horizontal plane. Therefore, on a face of the inside of the guide member 107*c*, that is, on a face facing the first microphone 113*a*, foreign matters having entered from the aperture 109*a* are unlikely to deposit.

Figure 4:
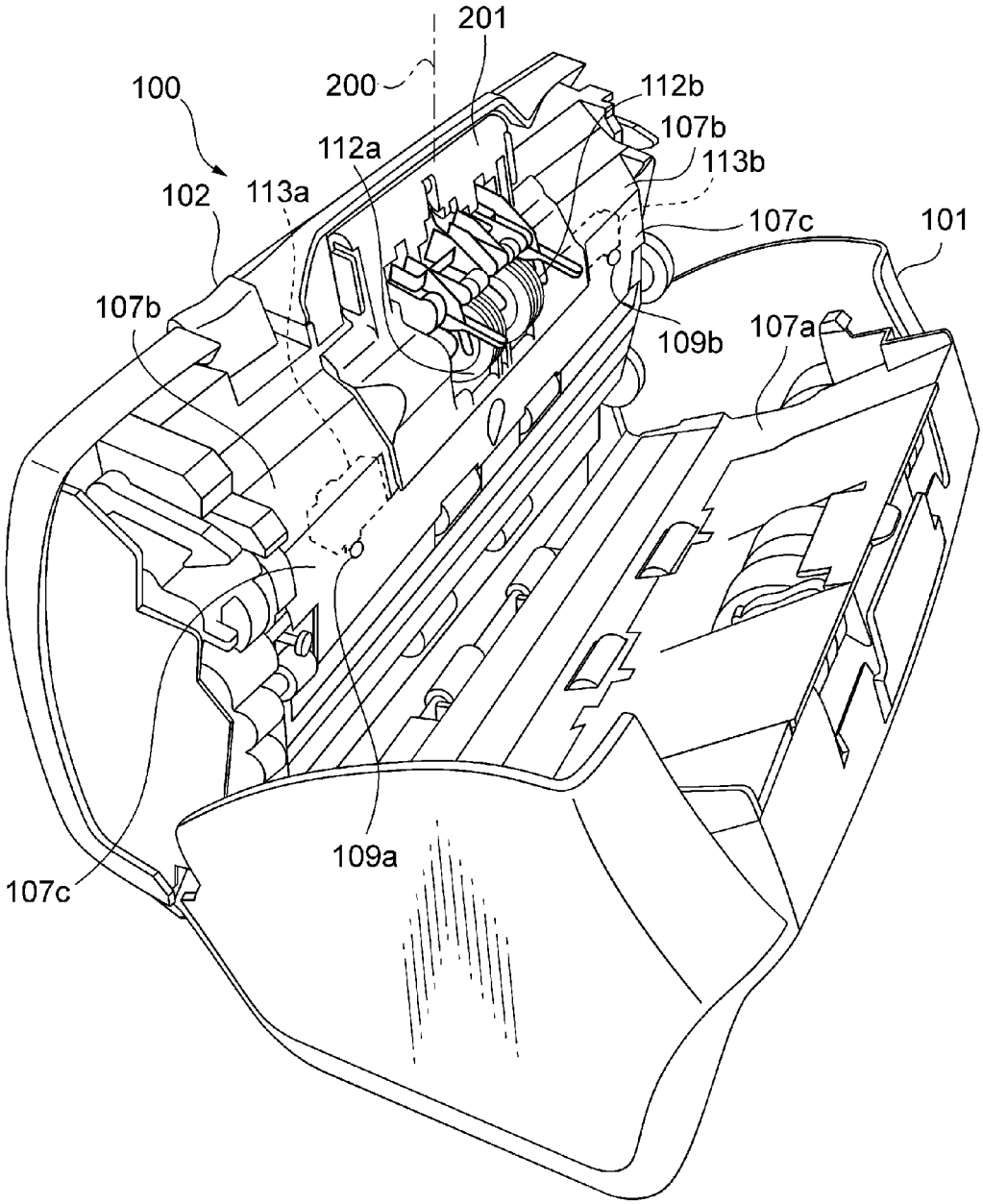
FIG. 4 is a perspective view of a state where an upper housing 102 is opened.
Figure 5:
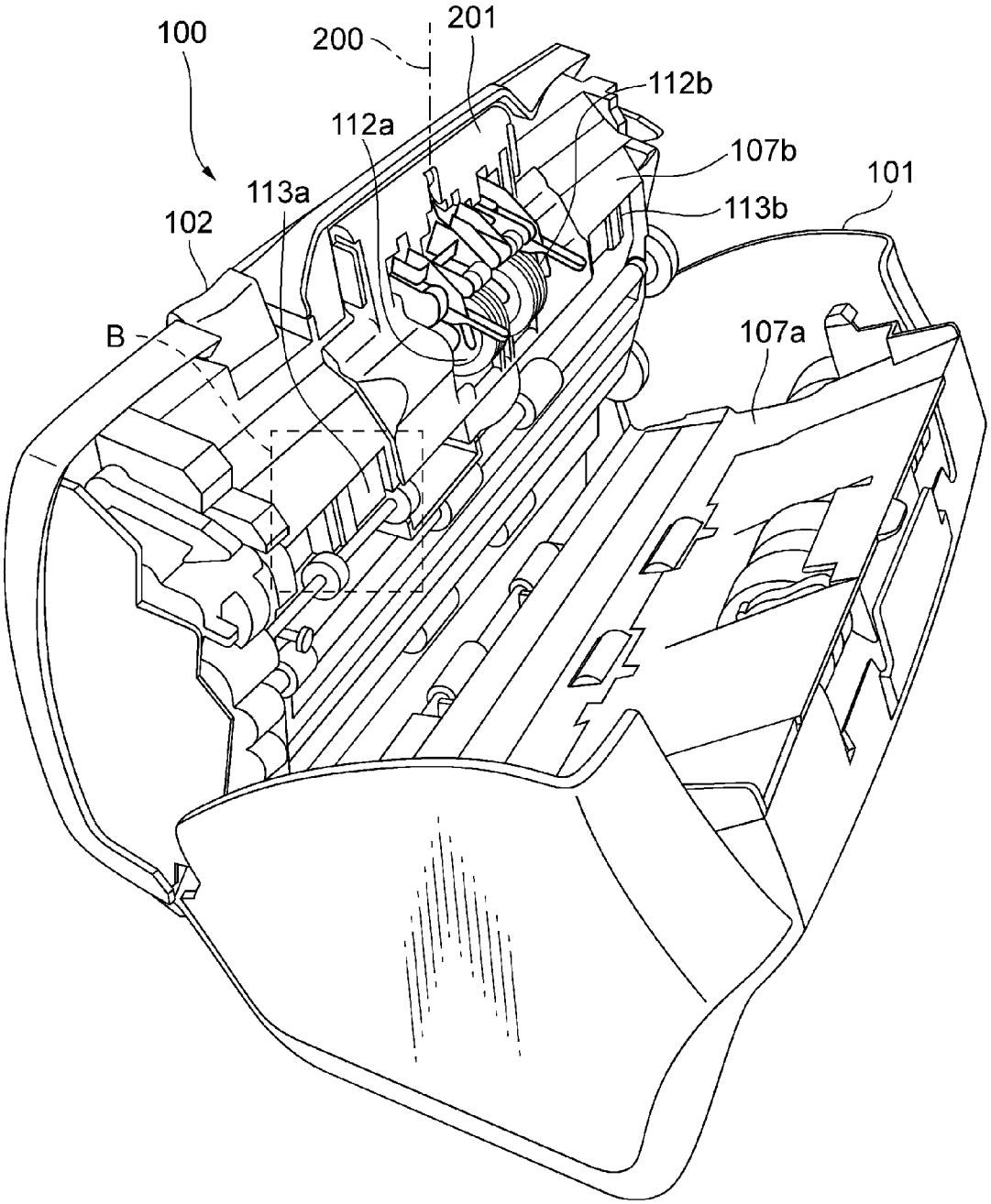
FIG. 5 is a perspective view of a state where the upper housing 102 is opened and a guide member 170*c* is removed.

FIG. 4 is a perspective view of a state where the upper housing 102 is opened, and FIG. 5 is a view illustrating a state where further, a guide member 170*c* is removed. Referring to FIG. 4 and FIG. 5, one example of a structure in the vicinity of a position where the first microphone 113*a* and the second microphone 113*b* are attached to the upper housing 102 will be described.

As described above, an upper face of the lower housing 101 forms the lower guide 107*a* of the conveyance path of a paper, and a lower face of the upper housing 102 forms the upper guide 107*b* of the conveyance path of a paper. Further, the guide member 107*c* is attached on a downstream side of the retard roller 112 to function as an upper guide of the conveyance path. The lower housing 101 has a cover 201 that is detachable from the lower housing 101 and openable at the time of replacement of the retard roller 112, cleaning, and the like.

The first microphone 113*a* and the second microphone 113*b* are disposed in the back of the guide member 107*c*. In FIG. 4, the positions of the first microphone 113*a* and the second microphone 113*b* are illustrated by dashed lines. When the guide member 107*c* is removed as illustrated in FIG. 5, the first microphone 113*a* and the second microphone 113*b* are exposed.

The first microphone 113*a* is disposed on a left side of the apparatus center illustrated by a dashed-dotted line 200 when viewed from an upstream of the conveyance path, and the second microphone 113*b* is disposed on a right side of the apparatus center 200. For example, the first microphone 113*a* may be disposed on a left side of the retard roller 112*a*, the retard roller 112*a* being disposed on a left side of the apparatus center 200. The second microphone 113*b* may be disposed on a right side of the retard roller 112*b*, the retard roller 112*b* being disposed on a right side of the apparatus center 200.

FIG. 4 illustrates the positions of the apertures 109*a* and 109*b* provided for the guide member 107*c*. The aperture 109*a* is disposed in a position on the left side of the apparatus center 200 in the same manner as the first microphone 113*a*. The aperture 109*b* is disposed in a position of the right side of the apparatus center 200 in the same manner as the second microphone 113*b*. In the example of FIG. 4, the apertures 109*a* and 109*b* are disposed in a downstream of the conveyance direction from the first microphone 113*a* and the second microphone 113*b*, respectively.

Figure 6:
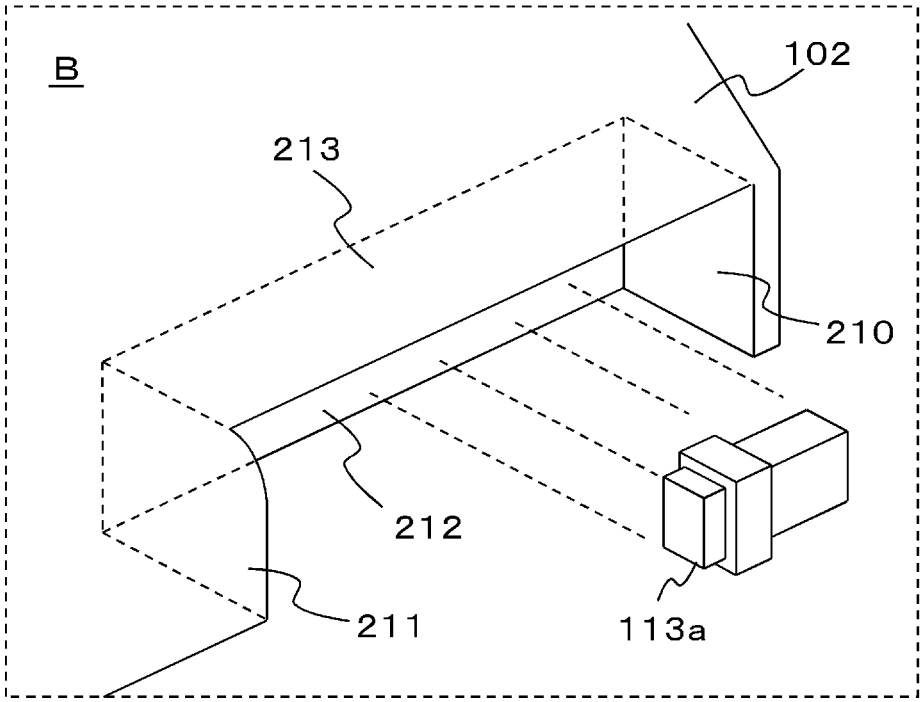
FIG. 6 is an enlarged view of the B portion of FIG. 5.

FIG. 6 is an enlarged view of the B portion of FIG. 5 where the first microphone 113*a* is attached. In a microphone placement position, walls 210, 211, 212, and 213 facing the first microphone 113*a* are formed by shaping the upper housing 102.

The wall 210 is disposed between the first microphone 113*a* and the retard roller 112. The wall 211 is positioned across the first microphone 113*a* on an opposite side thereof from the retard roller 112 and opposed to the first microphone 113*a*. The wall 212 is positioned across the first microphone 113*a* on an opposite side thereof from the conveyance path of a paper and opposed to the first microphone 113*a*. The wall 213 is disposed on an upstream side of the conveyance path of a paper from the first microphone 113*a* and opposed to the first microphone 113*a*.

Similarly, in the second microphone 113*b*, a wall disposed between the second microphone 113*b* and the retard roller 112 may be provided for the upper housing 102. A wall positioned across the second microphone 113*b* on an opposite side thereof from the retard roller 112 and opposed to the second microphone 113*b* may be provided for the upper housing 102. A wall positioned across the second microphone 113*b* on an opposite side thereof from the conveyance path of a paper and opposed to the second microphone 113*b* may be provided for the upper housing 102. A wall disposed on an upstream side of the conveyance path of a paper from the second microphone 113*b* and opposed to the second microphone 113*b* may be provided for the upper housing 102.

Figure 7:
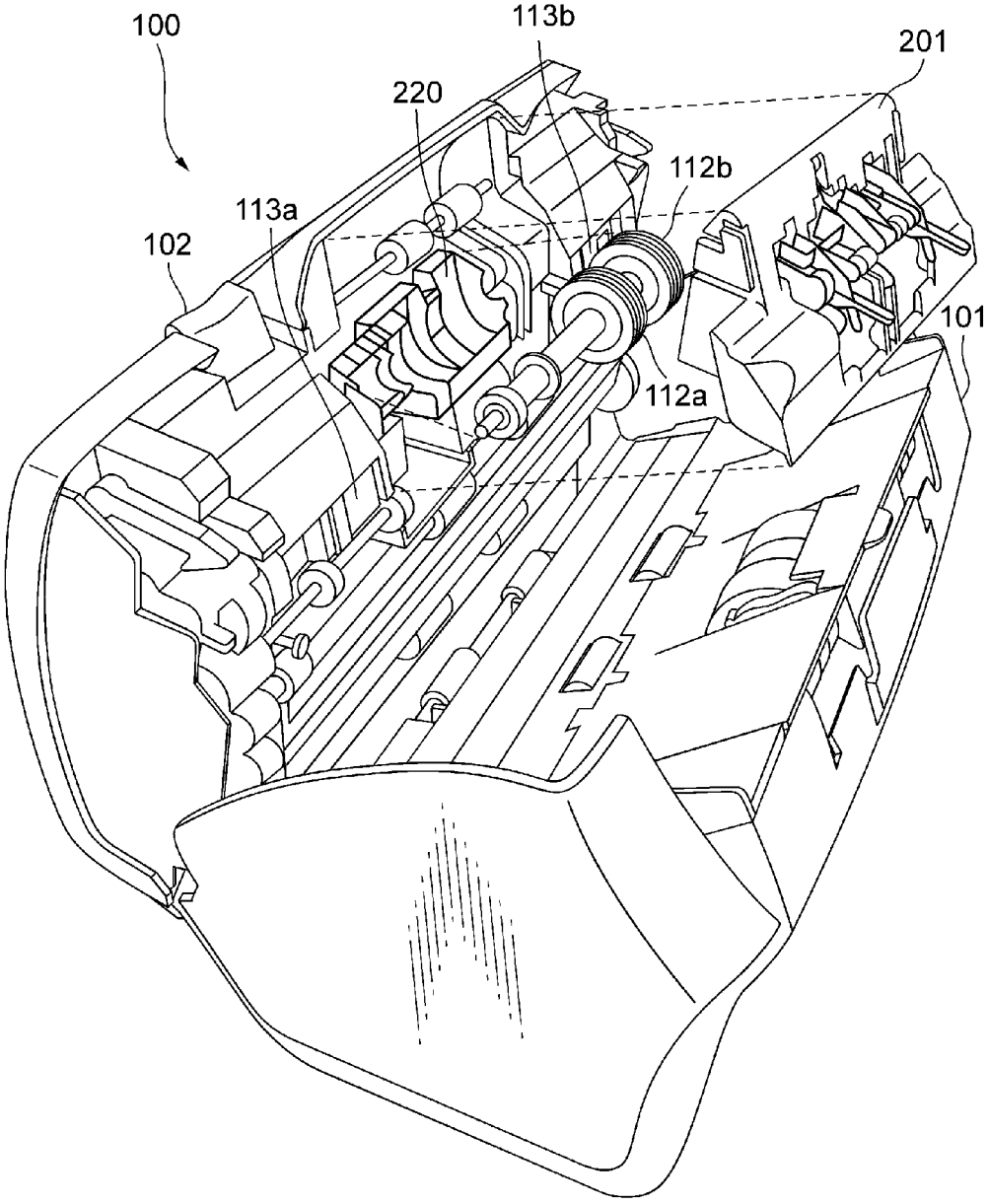
FIG. 7 is a perspective view of a state where the upper housing 102 is opened, and the guide member 107*c* and a cover 201 are removed.

FIG. 7 is a perspective view of a state where the upper housing 102 is opened, and the guide member 107*c* and the cover 201 are removed. The upper housing 102 has a roller accommodation depression 220 formed by shaping the upper housing 102 so as for the retard rollers 112*a* and 112*b* to be fitted therein. The roller accommodation depression 220 is positioned across the retard roller 112 on an opposite side thereof from the conveyance path of a paper, and an inner face of the roller accommodation depression 220 faces the retard roller 112.

Figure 8:
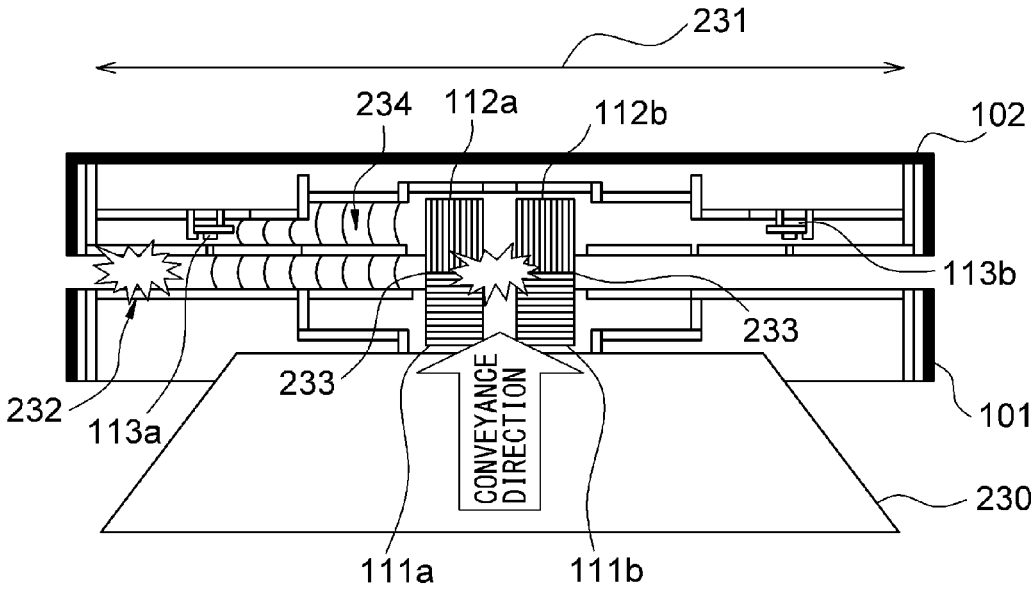
FIG. 8 is a view illustrating a sound due to jam occurrence and a conveyance sound.

FIG. 8 is a view illustrating a sound due to jam occurrence and a conveyance sound. In the case of a skew jam and a staple jam, in the vicinity of both edges 232 of a sheet width direction 231 of the conveyance path of a paper 230, a sound generated by a jam occurs. The skew jam refers to a paper jam generated by conveyance of a misaligned paper. The staple jam refers to a paper jam generated by conveyance of stapled papers.

On the other hand, when a folded or wrinkled paper is conveyed, a conveyance sound and a separation sound are generated in a nip portion 233 sandwiching the paper by the sheet feeding roller 111 and the retard roller 112. When a conveyance sound and a separation sound generated in the nip portion 233 are propagated as seen in the example illustrated by an arrow 234, these sounds may be detected by the first microphone 113*a*. As a result, the conveyance sound and the separation sound generated in the nip portion 233 may be detected erroneously as a sound generated by a jam. This case is the same as in the second microphone 113*b*.

Figure 9:
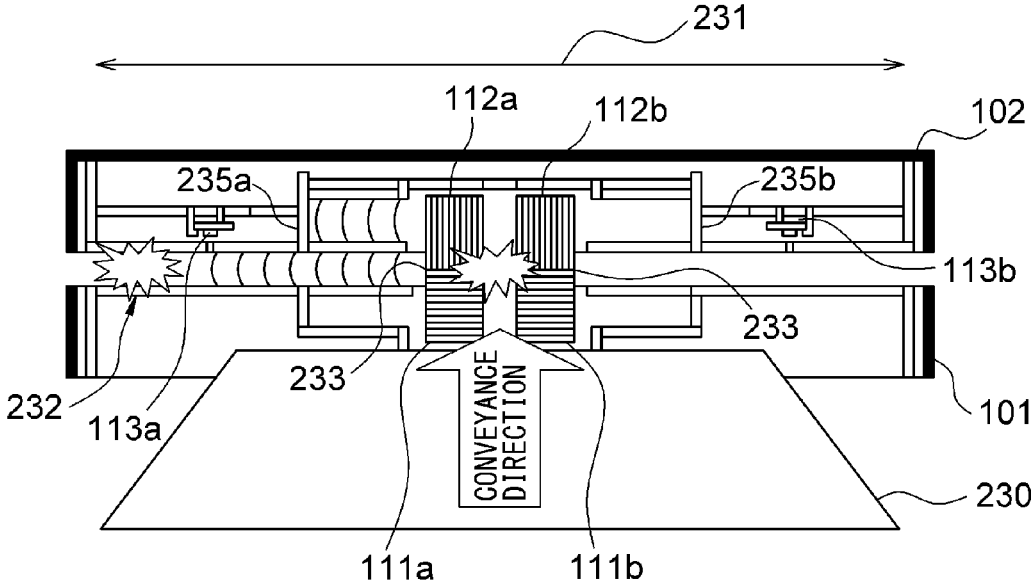
FIG. 9 is a view illustrating a sound shield.

FIG. 9 is a view illustrating a sound shield. The paper conveyance apparatus 100 includes sound shields 235*a* and 235*b* for shielding a conveyance sound and a separating sound generated from the nip portion 233. When the sound shields 235*a* and 235*b* are provided, it becomes difficult for the first microphone 113*a* and the second microphone 113*b* to detect a conveyance sound and a separation sound generated in the nip portion 233. As a result, since a conveyance sound and a separation sound other than a sound due to jam occurrence become unlikely to overlap with a sound detected with the first microphone 113*a* and the second microphone 113*b*, a detection accuracy of a jam is enhanced.

Figure 10:
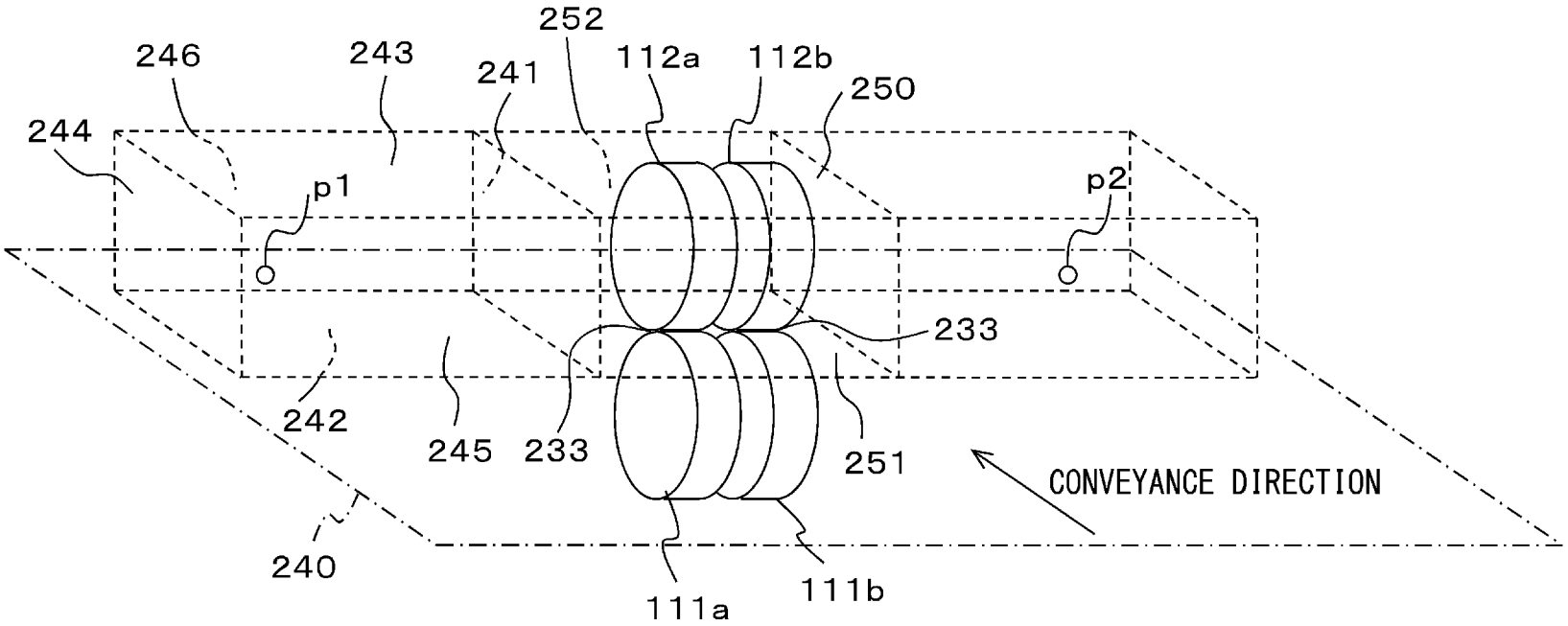
FIG. 10 is a view illustrating each face facing a sound receiving point and a retard roller.

FIG. 10 is a view illustrating each face facing a sound receiving point and a retard roller. Referring to FIG. 10, a placement position of a sound shield for shielding a conveyance sound and a separation sound generated from the nip portion 233 will be described below. The reference symbol 240 represents a conveyance path of a paper. The reference symbol p1 represents a sound receiving position of the first microphone 113*a*, i.e., a position of the sound aperture 132 of the microphone device 131 of the first microphone 113*a*. The reference symbol p2 represents a sound receiving position of the second microphone 113*b*. Hereinafter, the sound receiving positions of the first microphone 113*a* and the second microphone 113*b* will be represented by sound receiving points p1 and p2, respectively.

A face facing the sound receiving point p1 will be described below. A face 241 is a face located between the sound receiving point p1 and the retard roller 112. A face 242 is a face located between the sound receiving point p1 and the conveyance path 240. A face 243 is a face located across the sound receiving point p1 on an opposite side thereof from the conveyance path 240.

A face 244 is a face located across the sound receiving point p1 on an opposite side thereof from the retard roller 112. A face 245 and a face 246 are faces located on an upstream side and a downstream side of the conveyance path 240 of a paper from the sound receiving point p1, respectively.

Figure 11A:
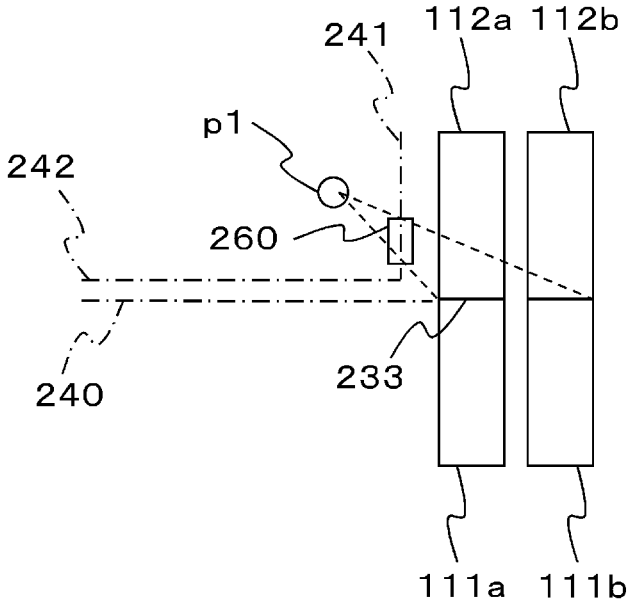
FIG. 11A is a view illustrating a first example of the sound shield.

FIG. 11A is a view illustrating a first example of the sound shield. For example, a sound shield 260 may be disposed on the face 241 located between the sound receiving point p1 and the retard roller 112. For example, the sound shield 260 is disposed on a straight line between the nip potion 233 and the sound receiving point p1. For example, the sound shield 260 may be provided so as to cover a range of a solid angle covered by the nip portion 233 as seen from the sound receiving point p1.

Figure 11B:
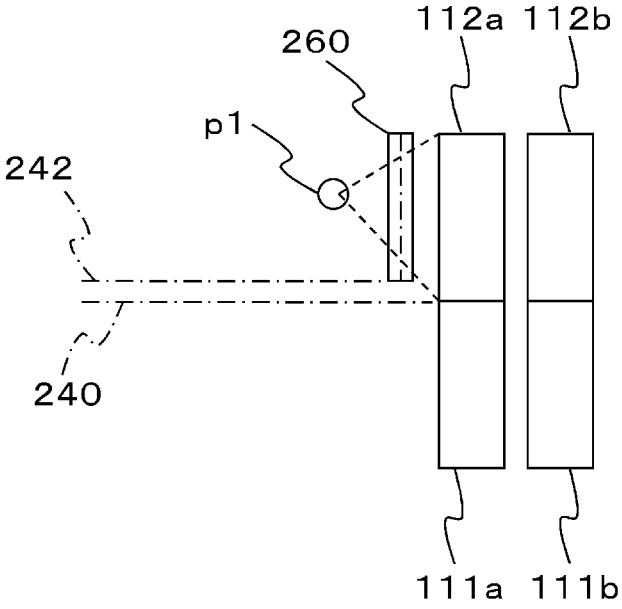
FIG. 11B is a view illustrating a second example of the sound shield.

FIG. 11B is a view illustrating a second example of the sound shield. In the example of FIG. 11B, the sound shield 260 may be a wall located between the sound receiving point p1 and the retard roller 112 and opposed to the sound receiving point p1. For example, the sound shield 260 may be provided so as to cover a range of a solid angle covered by the retard roller 112 as seen from the sound receiving point p1. For example, the sound shield 260 of FIG. 11B can be realized using the wall 210 illustrated in FIG. 6.

Figure 12A:
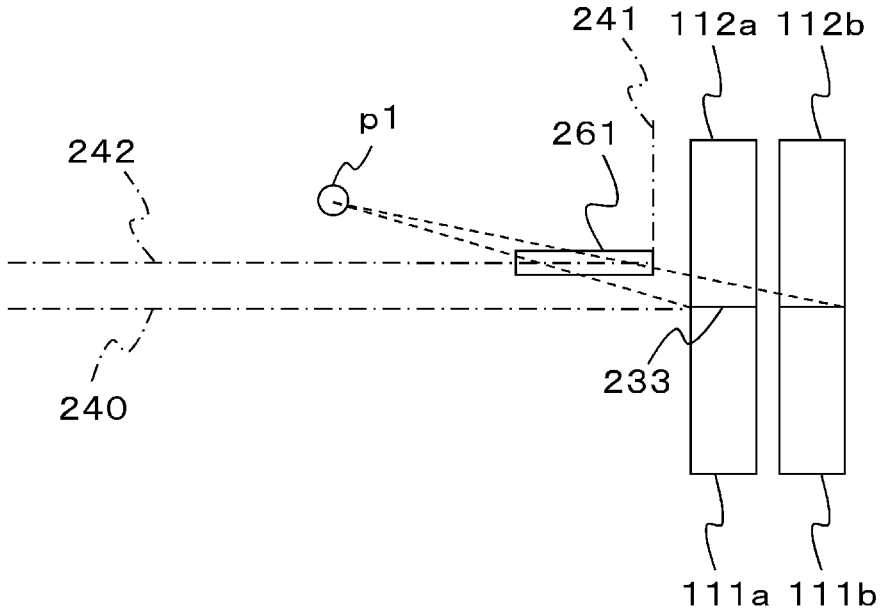
FIG. 12A is a view illustrating a third example of the sound shield.

FIG. 12A is a view illustrating a third example of the sound shield. In the example of FIG. 12A, the sound receiving point p1 is more distant from the nip portion 233 than in a relative positional relation between the sound receiving point p1 and the nip portion 233 in FIG. 11A and FIG. 11B. Alternatively, the sound receiving point p1 is closer to the conveyance path 240 than in a relative positional relation between the sound receiving point p1 and the conveyance path 240 in FIG. 11A and FIG. 11B. Therefore, when a sound shield is disposed on the face 241 located between the sound receiving point p1 and the retard roller 112, the sound shield does not block a linear path between the nip portion 233 and the sound receiving pint p1.

Therefore, for example, a sound shield 261 may be disposed on the face 242 located between the sound receiving point p1 and the conveyance path 240. For example, the sound shield 261 is disposed on a straight line between the nip potion 233 and the sound receiving point p1. For example, the sound shield 261 may be provided so as to cover a range of a solid angle covered by the nip portion 233 as seen from the sound receiving point p1.

Figure 12B:
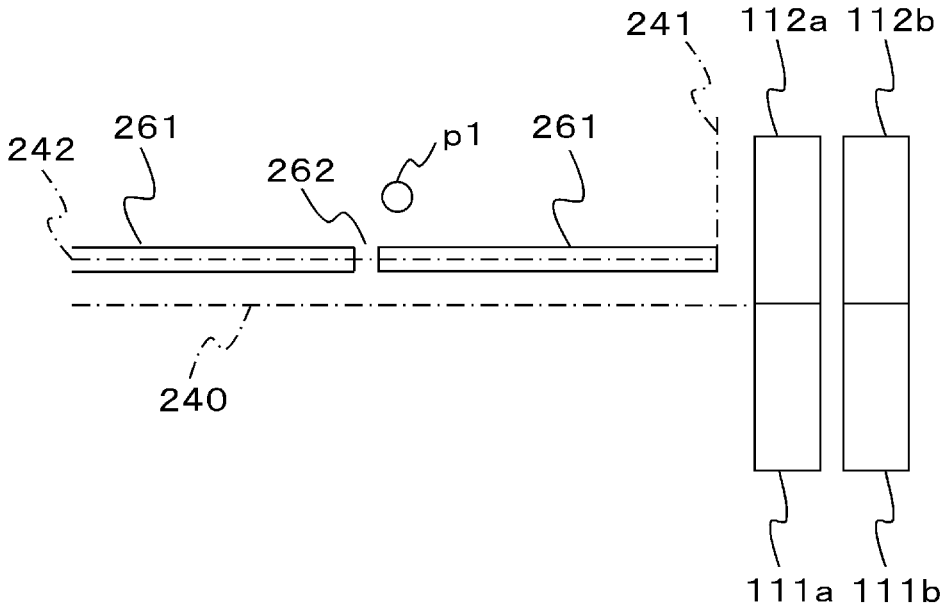
FIG. 12B is a view illustrating a forth example of the sound shield.

FIG. 12B is a view illustrating a forth example of the sound shield. In the example of FIG. 12B, the sound shield 261 may be a wall located between the sound receiving point p1 and the conveyance path 240 and opposed to the sound receiving point p1. For example, with the exception of the through-aperture 262 for sound reception, the sound shield 261 may be provided so as to block the space between the sound receiving point p1 and the conveyance path 240. For example, the sound shield 261 of FIG. 12B can be realized by the guide member 107*c* illustrated in FIG. 4.

Note that any one of the sound shields 260 of FIG. 11A and FIG. 11B may be provided by a combination with any one of the sound shields 261 of FIG. 12A and FIG. 12B. For example, while the guide member 107*c* is attached as illustrated in FIG. 4, the guide member 107*c* functions as the sound shield 261 of FIG. 12B and the wall 210 illustrated in FIG. 6 functions as the sound shield 260 of FIG. 11B.

Refer to FIG. 10. A sound shield may be disposed on the face 243 located across the sound receiving point p1 on an opposite side thereof from the conveyance path 240 of a paper. An example of the sound shield provided for the face 243 is the wall 212 illustrated in FIG. 6. When the face 243 is provided with a sound shield, propagation of a conveyance sound and a separation sound through a space across the sound receiving point p1 on an opposite side thereof from the conveyance path 240 can be reduced.

A sound shield may be disposed on the face 244 located across the sound receiving point p1 on an opposite side thereof from the retard roller 112. An example of the sound shield provided for the face 244 is the wall 211 illustrated in FIG. 6. When the face 244 is provided with a sound shield, propagation of a conveyance sound and a separation sound through a space across the sound receiving point p1 on an opposite side thereof from conveyance path 240 and a space across the sound receiving point p1 on an opposite side thereof from the retard roller 112 can be reduced.

A sound shield may be disposed on the face 245 located on an upstream side of the conveyance path 240 of a paper from the sound receiving point p1. An example of the sound shield provided for the face 245 is the wall 213 illustrated in FIG. 6. When the face 245 is provided with a sound shield, propagation of a conveyance sound and a separation sound through a space on an upstream side of the conveyance path 240 of a paper from the sound receiving point p1 can be reduced.

A sound shield may be disposed on the face 246 located on a downstream side of the conveyance path 240 of a paper from the sound receiving point p1. As an example of the sound shield provided for the face 246, a wall disposed on a downstream side of the conveyance path of a paper from the first microphone 113*a* and opposed to the first microphone 113*a* may be formed in the upper housing 102. When the face 246 is provided with a sound shield, propagation of a conveyance sound and a separation sound through a space on a downstream side of the conveyance path 240 of a paper from the sound receiving point p1 can be reduced.

Note that a sound shield can be provided for respective faces in any combination of the faces 241 to 246 described above. For example, both of the faces 241 and 242 may be provided with a sound shield. When a plurality of faces are provided with a sound shield, a sound shield effect can be enhanced. Further, for example, with the exception of a through-aperture for sound receiving disposed on the face 242, a sound shield may be provided so as to cover all of the faces 241 to 246 facing the sound receiving point p1. A sound effect can be defined by covering all of the faces facing the sound receiving point p1. With respect to the sound receiving point p2, a sound shield may be provided in the same manner.

Next, a face facing the retard roller 112 will be described. A face 250 is a face located across the retard roller 112 on an opposite side thereof from the conveyance path 240. Faces 251 and 252 are faces located on an upstream side and a downstream side of the conveyance path 240 of a paper from the retard roller 112, respectively.

A sound shield may be disposed on the face 250 located across the retard roller 112 on an opposite side thereof from the conveyance path 240. An example of the sound shield provided for the face 250 is the roller accommodation depression 220 illustrated in FIG. 7. When the face 250 is provided with a sound shield, propagation of a conveyance sound and a separation sound through a space across the retard roller 112 on an opposite side thereof from the conveyance path 240 can be reduced.

A sound shield may be disposed on the faces 251 and 252 located on an upstream side and a downstream side of the conveyance path 240 of a paper from the retard roller 112, respectively. As an example of the sound shields provided for the faces 251 and 252, walls disposed on an upstream side and a downstream side of the conveyance path of a paper from the retard roller 112, respectively, and opposed to the retard roller 112 may be formed in the upper housing 102 and/or the cover 201. When the faces 251 and 251 are provided with a sound shield, propagation of a conveyance sound and a separation sound through spaces on both an upstream side and a downstream side of the conveyance path 240 of a paper from the retard roller 112, respectively, can be reduced.

A sound shield can be disposed on faces in any combination of the faces 250 to 252 or on all of the faces described above. When a plurality of faces are provided with a sound shield, a sound shield effect can be enhanced. Further, a part or all of the faces facing the sound receiving point p1 and/or p2 may be provided with a sound shield, and also a part or all of the faces facing the retard roller 112 may be provided with a sound shield.

Figure 13:
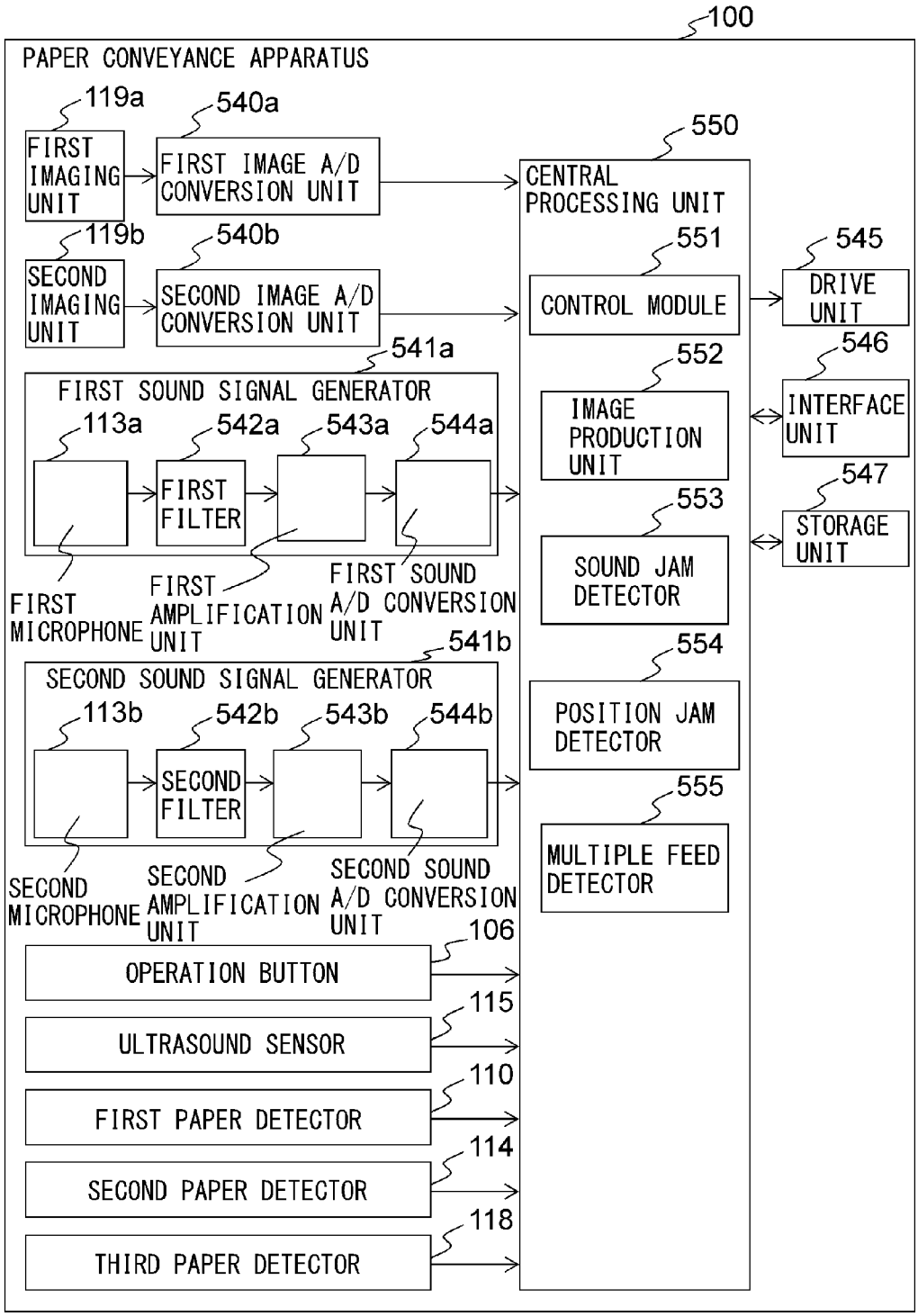
FIG. 13 is a block diagram illustrating a schematic configuration of the paper conveyance apparatus 100.

FIG. 13 is a block diagram illustrating a schematic configuration of the paper conveyance apparatus 100. In addition to the above-mentioned configuration, the paper conveyance apparatus 100 further includes a first image A/D conversion unit 540*a*, a second image A/D conversion unit 540*b*, a first sound signal generator 541*a*, a second sound signal generator 541*b*, a drive unit 545, an interface unit 546, a storage unit 547, a central processing unit 550 and the like.

The first image A/D conversion unit 540*a* produces digital image data via analog/digital conversion of an analog image signal output from the first imaging unit 119*a* to be output to the central processing unit 550. In the same manner, the second image A/D conversion unit 540*b* produces digital image data via analog/digital conversion of an analog image signal output from the second imaging unit 119*b* to be output to the central processing unit 550. Hereinafter, each of the above-mentioned digital image data is referred to as a read image.

The first sound signal generator 541*a* includes a first microphone 113*a*, a first filter 542*a*, a first amplification unit 543*a*, a first sound A/D conversion unit 544*a* and the like. The first filter 542*a* applies a bandpass filter allowing a signal of a predetermined frequency band to pass through to a signal output from the first microphone 113*a* to be output to the first amplification unit 543*a*. The first amplification unit 543*a* amplifies a signal output from the first filter 542*a* to be output to the first sound A/D conversion unit 544*a*. The first sound A/D conversion unit 544*a* converts an analog signal output from the first amplification unit 543*a* to a first digital original signal to be output to the central processing unit 550.

The second sound signal generator 541*b* includes a second microphone 113*b*, a second filter 542*b*, a second amplification unit 543*b*, a second sound A/D conversion unit 544*b* and the like. The second filter 542*b* applies a bandpass filter allowing a signal of a predetermined frequency band to pass through to a signal output from the second microphone 113*b* to be output to the second amplification unit 543*b*. The second amplification unit 543*b* amplifies a signal output from the second filter 542*b* to be output to the second sound A/D conversion unit 544*b*. The second sound A/D conversion unit 544*b* converts an analog signal output from the second amplification unit 543*b* to a second digital original signal to be output to the central processing unit 550.

The drive unit 545 includes one or a plurality of motors, and based on a control signal from the central processing unit 550, rotates the sheet feeding roller 111, the retard roller 112, the first conveyance roller 116, and the second conveyance roller 120 to perform a conveyance operation of a paper.

The interface unit 546 has an interface circuit conforming to a serial bus such as USB and the like, and electrically connects to an information processing device (for example, a personal computer, a mobile information terminal, and the like) which is not illustrated to transmit/receive a read image and various types of information. Further, the interface unit 546 may be connected to a flash memory and the like to store read images.

The storage unit 547 has a memory device such as a RAM (Random Access Memory) and a ROM (Read Only Memory), a fixed disk drive such as a hard disk drive, or a portable storage device such as a flexible disk and an optical disk. Further, the storage unit 547 stores a computer program, a data base, a table and the like for use in various types of processings of the paper conveyance apparatus 100. The computer program may be installed in the storage unit 547 from a computer-readable portable recording medium such as a CD-ROM (compact disk read only memory), a DVD-ROM (digital versatile disk read only memory), and the like, using a well-known setup program. Still further, the storage unit 547 stores read images.

The central processing unit 550 includes a CPU (Central Processing Unit) and operates based on a program previously stored in the storage unit 547. Note that the central processing unit 550 may be configured using a DSP (digital signal processor), a LSI (large scale integration), a ASIC (Application Specific Integrated Circuit), a FPGA (Field-Programming Gate Array), or the like.

The central processing unit 550 is connected to the operation button 106, the first paper detector 110, the second paper detector 114, the ultrasound sensor 115, the third paper detector 118, the first imaging unit 119*a*, the second imaging unit 119*b*, the first image A/D conversion unit 540*a*, the second image A/D conversion unit 540*b*, the first sound signal generator 541*a*, the second sound signal generator 541*b*, the drive unit 545, the interface unit 546, and the storage unit 547 to control each of these units.

The central processing unit 550 executes a drive control of the drive unit 545 and a paper reading control of the imaging unit 119 and the like to acquire a read image. Further, the central processing unit 550 includes a control module 551, an image production unit 552, a sound jam detector 553, a position jam detector 554, and a multiple feed detector 555. Each of these units is a functional module implemented by a software operated on a processor. Note that these units may each be configured using an integrated circuit, a microprocessor, and a firmware and the like independent of each other.

The sound jam detector 553 executes sound jam detection processing. In the sound jam detection processing, the sound jam detector 553 determines whether a jam has occurred based on a first original signal acquired from the first sound signal generator 541*a* and a second original signal acquired from the second sound signal generator 541*b*. Hereinafter, there are cases where a jam in which the sound jam detector 550 determines whether the jam has occurred based on each original signal may also be referred to as a sound jam.

The position jam detector 554 executes position jam detection processing. In the position jam detection processing, the position jam detector 554 determines whether a jam has occurred based on a second paper detection signal acquired from the second paper detector 114 and a third paper detection signal acquired from the third paper detector 118. Hereinafter, there are cases where a jam in which the position jam detector 554 determines whether the jam has occurred based on the second paper detection signal and the third paper detection signal may also be referred to as a position jam.

The multiple feed detector 555 executes multiple feed detection processing. In the multiple feed detection processing, the multiple feed detector 555 determines whether multiple feed of papers has occurred based on an ultrasound signal acquired from the ultrasound sensor 115.

The control module 551 determines whether an abnormality has occurred in paper conveyance processing. The control module 551 determines that an abnormality has occurred in the case of at least one of a sound jam, a position jam, and multiple feed of papers. In the case of abnormality occurrence in the paper conveyance processing, the control module 551 sets an abnormality occurrence flag to ON.

In the case of ON of the abnormality occurrence flag, the control module 551 stops the drive unit 545 as abnormal processing to stop the conveyance of a paper. At the same time, the control module 551 notifies the user of abnormality occurrence using a speaker, a LED (Light Emitting Diode) or the like not illustrated, and sets the abnormality occurrence flag to OFF.

When the abnormality occurrence flag is not set to ON, the image production unit 552 causes the first imaging unit 119*a* and the second imaging unit 119*b* to read a conveyed paper to acquire a read image via the first image A/D conversion unit 540*a* and the second image A/D conversion unit 540*b*, respectively. The central processing unit 550 transmits an acquired read image to an information processing unit which is not illustrated, via the interface unit 546. Note that when the central processing unit 550 is not connected to the information processing unit, the central processing unit 550 stores the acquired read image in the storage unit 547.

The paper conveyance apparatus 100 of the present example includes a sound shield for shielding a conveyance sound and a separation sound, generated from a nip portion of the sheet feeding roller 111 and the retard roller 112, from the first microphone 113*a* and the second microphone 113*b*. As a result, it is difficult for a conveyance sound and a separation sound other than a sound due to occurrence of a jam to overlap with a sound signal detected by the first microphone 113*a* and the second microphone 113*b*. Therefore, a determination accuracy based on the sound jam determination processing executed by the sound jam detector 553 using this sound signal is enhanced.

Further, when a plurality of faces facing the sound receiving positions of the first microphone 113*a* and the second microphone 113*b* and the retard roller 112 are provided with a sound shield, a conveyance sound and a separation sound can be further reduced. Still further, when all of the faces facing the first microphone 113*a* and/or the second microphone 113*b* are covered, a sound shield effect can be further enhanced.

The apparatus disclosed in the present specification reduces a decrease in a detection accuracy of a jam based on a sound generated in a conveyance path, the decrease resulting from a sound other than a sound generated by jam occurrence.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveyance apparatus comprising:

a conveyance roller module including a pair of sheet feeding rollers, and a separation roller opposite to said pair of sheet feeding rollers across a paper conveyance path;

a sound receiving member positioned on the same side as one side of the paper conveyance path, the one side including any one roller of the conveyance roller module;

a sound shield positioned on a straight line between a nip portion of the conveyance roller module and the sound receiving member, and configured to reduce a conveyance sound or a separation sound generated in the nip portion of the conveyance roller module;

a sound signal generator for generating a sound signal in response to a sound detected by the sound receiving member; and a sound jam detector for determining whether a jam has occurred based on the sound signal.

2. The paper conveyance apparatus according to claim 1, wherein the sound shield is disposed between the paper conveyance path and the sound receiving member.

3. The paper conveyance apparatus according to claim 2, further comprising a second sound shield positioned between said any one roller and the sound receiving member.

4. The paper conveyance apparatus according to claim 1, wherein the sound shield is disposed between said any one roller and the sound receiving member.

5. The paper conveyance apparatus according to claim 4, further comprising a second sound shield positioned between the paper conveyance path and the sound receiving member.

6. The paper conveyance apparatus according to claim 1, further comprising a second sound shield positioned across the one roller on an opposite side thereof from the paper conveyance path, and opposite to said any one roller.

7. The paper conveyance apparatus according to claim 1, further comprising a second sound shield positioned on a downstream side and/or an upstream side of the paper conveyance path from the one roller, and opposite to said any one roller.

8. The paper conveyance apparatus according to claim 1, further comprising a second sound shield positioned across the sound receiving member on an opposite side thereof from the paper conveyance path, and opposite to the sound receiving member.

9. The paper conveyance apparatus according to claim 1, further comprising a second sound shield positioned on a downstream side and/or an upstream side of the paper conveyance path from the sound receiving member, and opposite to the sound receiving member.

10. The paper conveyance apparatus according to claim 1, further comprising a second sound shield positioned across the sound receiving member on an opposite side thereof from said any one roller, and opposite to the sound receiving member.

* * * * *